United States Patent [19]

Mizutani et al.

[11] 4,002,579

[45] Jan. 11, 1977

[54] DETERGENT COMPOSITION

[75] Inventors: Hiroshi Mizutani, Yachiyo; Fumikatsu Tokiwa; Tetsuya Imamura, both of Wakayama; Toshiro Sakurada, Funabashi, all of Japan

[73] Assignee: Kao Soap Company, Ltd., Tokyo, Japan

[22] Filed: Feb. 12, 1975

[21] Appl. No.: 549,323

Related U.S. Application Data

[63] Continuation of Ser. No. 267,195, June 28, 1972, abandoned.

[30] Foreign Application Priority Data

July 1, 1971 Japan ..... 46-48287

[52] U.S. Cl. ..... 252/544; 252/142; 252/548; 252/DIG. 1

[51] Int. Cl.[2] ..... C11D 3/26

[58] Field of Search ..... 252/548, DIG. 1, 529, 252/544, 142, 89, 99, 98, 121, 135

[56] References Cited

UNITED STATES PATENTS

| | | | |
|---|---|---|---|
| 3,235,505 | 2/1966 | Tuvell | 252/89 |
| 3,629,121 | 12/1971 | Eldib | 252/89 |
| 3,661,787 | 5/1972 | Brown | 252/98 |
| 3,700,599 | 10/1972 | Mizuno | 252/99 |
| 3,701,735 | 10/1972 | Finck | 252/135 |
| 3,707,503 | 12/1972 | Kenny | 252/121 |

*Primary Examiner*—Mayer Weinblatt
*Assistant Examiner*—Edith R. Buffalow
*Attorney, Agent, or Firm*—Woodhams, Blanchard and Flynn

[57] ABSTRACT

A detergent composition comprising as essential components (A) 5 – 50 parts by weight of a surfactant component consisting of a mixture of (1) 5 – 95% by weight of a water-soluble polyoxyethylene sorbitan fatty acid monoester and (2) 95 – 5% by weight of a fatty acid alkylolamide, and (B) 1 – 50 parts by weight of an organic acid salt having a chelating ability.

3 Claims, No Drawings

DETERGENT COMPOSITION

This is a continuation of application Ser. No. 267,195, filed June 28, 1972 now abandoned.

BACKGROUND OF THE INVENTION

FIELD OF THE INVENTION

This invention relates to a detergent composition.

An object of this invention is to provide a detergent composition, especially a liquid detergent composition, which can remove soils rapidly and completely from agricultural products such as vegetables and fruits, marine products such as fishes and shellfishes, processed foodstuffs, and the like, and which exhibits a suitable foaming property during washing and is readily rinsed out after washing, and which is of a low toxicity.

SUMMARY OF THE INVENTION

The object of this invention can be attained by a detergent composition comprising, as the surfactant component (A), a mixture of a polyoxyethylene sorbitan fatty acid monoester and a fatty acid alkylolamide, and, as the builder component (B), an organic acid salt having a chelating ability.

The composition of this invention is composed of compounds of low toxicity.

The polyoxyethylene sorbitan fatty acid monoester, one of the components of the composition of this invention, has 5 – 50 oxyethylene units in the molecule and is a sorbitan monoester of a fatty acid having 8 – 22 carbon atoms. In general, these compounds are excellent in their emulsifying ability but, because of their poor foaming and wetting properties, they are not used as detergents, although they are used as emulsifiers.

In this invention, in order for such a hydrophilic, low toxicity surfactant to be utilizable as a detergent for foodstuffs, a fatty acid alkylolamide is incorporated as a second component in the detergent composition of this invention. These fatty acid alkylolamides include diethanolamides and polyoxyethylene monoethanolamides (10 – 20 oxyethylene units) of fatty acids having 8 – 22 carbon atoms, which are shown by the following formulas:

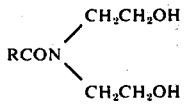

and $RCONHCH_2CH_2O(CH_2CH_2O)_nH$ (RCO has 8 – 22 carbon atoms and $n$ is an integer of 10 – 20)

These compounds can stabilize the foam and increase the wetting property of the composition by reducing the surface tension, whereby removal of microorganisms and oily soils can readily be accomplished.

In order to remove soils of inorganic substances and heavy metal agricultural chemicals adhering to foodstuffs, one or more of organic acid salts having dispersing and chelating properties, such as alkali metal and ammonium salts of gluconic acid, citric acid, malic acid, tartaric acid, oxalic acid and lactic acid, are incorporated as the third component in the detergent composition of this invention.

The detergent composition of this invention comprises (A) 5 – 50 parts by weight of a surfactant component consisting of (1) 5 – 95% by weight of a water-soluble polyoxyethylene sorbitan fatty acid monoester and (2) 95 – 5% of a fatty acid alkylolamide, and (B) 1 – 50 parts by weight of an organic acid salt having a chelating ability. In addition to these indispensable components, the composition of this invention may further comprise sodium sulfate for use in powdery forms of the composition, or a lower alcohol, lower alkyl benzene sulfonate or urea, for use in liquid forms of the composition, in order to maintain the stability of said liquid forms at low temperature.

This invention will now be further described by reference to the following illustrative Examples.

In the Examples, the measurement of the various values was carried out using an aqueous solution having a concentration of the detergent composition of this invention of 0.2% by weight and at a temperature of 20° C. The measurement of the foaming ability (mm) was done according to the Ross-Miles test method. The rinsing out property was measured by the following test. 100 cc of an aqueous 0.2% by weight solution of the detergent composition at a temperature of 20° C were placed in a 500 cc separating funnel, shaken by hand thirty times and left to stand, then drawing out the lower layer liquid. Then, 50 cc of water was added into the separating funnel, shaken by hand thirty times and left to stand, then drawing out the lower layer liquid. This procedure was repeated until the foam is completely removed. The rinsing out property (times) refers to the number of times of addition of the above 50 cc water required to remove the foam completely. The wetting ability is expressed in terms of the time required until a cottom canvas (10 mm × 10 mm), defatted with ethyl ether in advance, placed on the test solution is completely dipped and starts to sink under water. The dispersing ability was evaluated based on the dispersion state observed when carbon black (0.1 g/30 cc) or kaolin (1 g/30 cc) was dispersed in the sample solution and shown by the sedimented volume of carbon black or kaolin after 10 days. The smaller is the value (cc), the larger is the dispersing ability of the sample. For the determination of the detergency, a cloth soiled with a specimen soil which is rich especially in inorganic substances, containing carbon black, bentonite and oil and fat, was washed with the sample solution in a Terg-O-Tometer, and the detergency was calculated from the ratio of reflectivity of the cloth before and after the washing. Lead arsenate was employed as an agricultural chemical, and apples soiled with lead arsenate were washed. Then, the lead contained in the washing liquor and the lead remaining on apples were determined analytically, and the removability (%) was calculated.

Chinese cabbages were washed with a solution of the sample detergent to determine the detergency thereof on actual foodstuffs. The turbidity of the washing liquor was measured. A higher turbidity value indicates that a greater amount of the soil was removed and that the sample detergent had a higher detergency.

EXAMPLE 1

Compositions comprising polyoxyethylene (20 oxyethylene units) sorbitan monolaurate (PSML), lauric acid diethanolamide (LDA) and sodium citrate (C-Na) mixed at the ratios indicated in the following Table 1 were prepared, and the various properties of them were determined. The results are shown in the following Table.

Table 1

| Sample No. | PSML (parts) | LDA (parts) | C-Na (parts) | Foam height (mm) | Rinsing-out property (times) | Wetta-bility (sec) | Dispersing-ability for kaolin (cc) | Remova-bility of agricul-tural chemical (%) | Detergency on the soiled cloth (calcu-lated base on the arbitrary assigned value for the kitchen detergent as being 100) | Detergency on chinese cab-bages — tur-bidity (%) |
|---|---|---|---|---|---|---|---|---|---|---|
| 1-1 | 20 | — | — | 40 | 1> | 60 | 3.3 | 45 | 90 | 8 |
| 1-2 | 20 | 5 | — | 100 | 2 | 10 | 3.0 | 50 | 110 | 10 |
| 1-3 | 20 | 5 | 5 | 110 | 2 | 10 | 1.2 | 95 | 120 | 13 |
| 1-4 | Commercially avila-ble kitchen detergent | | | 220 | 7 | 4 | 1.0 | 50 | 100 | 12 |
| 1-5 | saline solution | | | — | 7 | 600< | 4.1 | 20 | 30 | 2 |
| 1-6 | city water | | | — | — | 600< | 4.0 | 20 | 30 | 2 |

PSML alone (Sample No. 1—1) is inferior in all properties. A composition formed by adding LDA to PSML (Sample No. 1–2) is sufficient in the foaming and wetting properties, but its detergency is insufficient. In contrast, the composition of this invention (Sample No. 1–3) has suitable foaming and rinsing-out properties, and its ability for removing various soils is superior to those of conventional kitchen detergents. Too high a wetting ability may damage the surfaces of fruits and vegetables, but the composition of this invention is acceptable because its wetting ability is moderate.

EXAMPLE 2

Various properties of the detergent were measured with respect to a detergent composition comprising 20 parts of polyoxyethylene (10 oxyethylene units) sorbitan monolaurate (PSMO), 5 parts of coconut oil diethanolamide (CDA) and 5 parts of sodium gluconate (G-Na) (Sample No. 2–1). The same measurements were carried out on a commercially available, neutral kitchen detergent and on water. The results are shown in Table 2.

Table 2

| Sample No. | Detergent | Foam height (mm) | Rinsing-out property (times) | Wetta-bility (sec) | Dispersing ability for carbon black (cc) | Removabil-ity of ag-ricultural chemical (%) | Detergency on the soiled cloth (calcu-lated based on the arbitrary assigned value for the kitchen detergent as being 100) | Detergency on chinese cabbages — tur-bidity (%) | Ratio of removal of micro-organisms from cabbages (%) |
|---|---|---|---|---|---|---|---|---|---|
| 2-1 | composition of this invention | 60 | 1 | 8 | 0.5 | 85 | 110 | 12 | 95 |
| 2-2 | neutral kitchen detergent | 220 | 7 | 4 | 0.4 | 50 | 100 | 12 | 90 |
| 2-3 | water | — | — | 600 | not dispersed | 20 | 20 | 2 | 60 |

From the results shown in the above Table it is seen that the composition of this invention has suitable foaming and wetting properties and an excellent detergency and that it can readily be rinsed out.

The embodiments of the invention in which an exclusive property or privilege is claimed are defined as follows:

1. A detergent composition consisting essentially of

A. from 5 to 50 parts by weight of surfactant component consisting essentially of 1. from 5 – 95% by weight of water-soluble polyoxyethylene sorbitan monoester of fatty acid having 8 to 22 carbon atoms and containing from 5 to 50 oxyethylene units in the molecule,
2. the balance being fatty acid alkylolamide selected from the group consisting of diethanolamides and polyoxyethylene monoethanolamides having 10 to 20 oxyethylene units in the molecule, of fatty acids having 8 to 22 carbon atoms, and B. from 1 to 50 parts by weight of an organic acid salt having a chelating ability selected from the group consisting of the alkali metal and ammonium salts of gluconic acid, citric acid, malic acid, tartaric acid, and lactic acid.

2. A composition according to claim 1, in which ingredient A (1) is polyoxyethylene sorbitan monolaurate, ingredient A (2) is lauric acid diethanolamide and ingredient (B) is sodium citrate.

3. A composition according to claim 1, in which ingredient A (1) is polyoxyethylene sorbitan monolaurate, ingredient A (2) is coconut oil diethanolamide and ingredient (B) is sodium gluconate.

* * * * *